US005360163A

United States Patent [19]

Dupre

[11] Patent Number: 5,360,163

[45] Date of Patent: Nov. 1, 1994

[54] ADJUSTABLE SNOW MAKING TOWER

[76] Inventor: Herman K. Dupre, c/o Seven Springs, Champion, Pa. 15622

[21] Appl. No.: 140,687

[22] Filed: Oct. 21, 1993

Related U.S. Application Data

[63] Continuation-in-part of Ser. No. 61,525, May 17, 1993, abandoned.

[51] Int. Cl.[5] ..... F25C 3/04

[52] U.S. Cl. ..... 239/14.2; 239/276; 239/280.5; 239/281; 248/122; 248/161

[58] Field of Search ..... 239/14.2, 273, 276, 239/280–281; 248/122, 125, 161, 413

[56] References Cited

U.S. PATENT DOCUMENTS

| | | | |
|---|---|---|---|
| 1,649,649 | 11/1927 | Bank | 239/280.5 |
| 2,546,460 | 3/1951 | Leeds | 248/122 |
| 2,857,201 | 10/1958 | Palmer | 239/281 |
| 3,706,414 | 12/1972 | Dupre | 239/14.2 |
| 3,804,355 | 4/1974 | Uroshevich | 248/125 |
| 3,814,319 | 6/1974 | Loomis | 239/14.2 |
| 3,822,825 | 7/1974 | Dupre | 239/14.2 |
| 3,964,682 | 6/1976 | Tropeano et al. | 239/14.2 |
| 4,199,103 | 4/1980 | Dupre | 239/14.2 |
| 4,722,324 | 2/1988 | Amen | 239/280.5 |
| 4,773,621 | 9/1988 | Gebhardt | 248/122 |
| 4,823,518 | 4/1989 | Dilworth et al. | 239/14.2 |
| 4,993,635 | 2/1991 | Dupre | 239/14.2 |
| 5,004,151 | 4/1991 | Dupre | 239/14.2 |
| 5,031,832 | 7/1991 | Ratnik et al. | 239/14.2 |
| 5,037,093 | 8/1991 | Roark, Jr. | 248/413 |
| 5,154,348 | 10/1992 | Ratnik et al. | 239/14.2 |

FOREIGN PATENT DOCUMENTS

| | | | |
|---|---|---|---|
| 3011579 | 10/1981 | Germany | 239/280.5 |

*Primary Examiner*—Karen B. Merritt
*Attorney, Agent, or Firm*—Carothers & Carothers

[57] ABSTRACT

An adjustable snow making tower including a vertical support pole anchored into the ground and having a support pipe coaxially received over this support pole for support of a snow tower for axial horizontal rotation on the support pole. A support arm is pivotally connected intermediate its opposite ends adjacent the upper end of this support pipe for pivotal movement substantially from horizontal to vertical. An elongated pipe snow making tower having air and water discharge nozzles at its upper end and air and water supply connections at its lower end, is supported adjacent its lower end to this support arm for pivotal movement therewith in a vertical plane. A lock mechanism is provided for temporary locking the support arm in any preselected vertical position between horizontal and vertical and a drive mechanism is also provided to assist in vertically raising or lowering the snow pipe tower together with a support arm about the support arm pivot. The support arm may also be utilized to pick up and support a snowgun above ground for more effective use in addition to or in substitution of the elongated pipe snow making tower.

15 Claims, 3 Drawing Sheets

ADJUSTABLE SNOW MAKING TOWER

This application is a continuation-in-part of U.S. application Ser. No. 08/061,525 filed on May 17, 1993 for ADJUSTABLE SNOW MAKING TOWER, now abandoned.

BACKGROUND OF THE INVENTION

This invention relates generally to fluid sprinkling and more particularly to snow making towers for ski slopes.

The typical snow making system for ski resorts includes a plurality of snow making towers which are positioned along the ski slope. However, placement of manufactured snow on the ski slope proper, becomes very difficult under varying wind conditions. In order to compensate for this, some snow making towers may be rotated to direct the snow making spray, or a nozzle at the top of the snow tower may be rotated.

For example, FIG. 4 of U.S. Pat. No. 3,814,391 (Loomis) issued on Jun. 4, 1974 for Method and Apparatus for Making Snow, illustrates a snow tower wherein the tower includes two separated elongated pipes for respectively supplying water and air under pressure to a nozzle at the top thereof for mixing and ejecting the mixture for the manufacture of snow. The nozzle at the top of the tower may be rotated for directional placement of snow through the use of guidelines. The entire system is supported from a pole.

Unfortunately, this particular design is such that in order to effectively manipulate the nozzle, the guidelines must be positioned approximately as high as the tower itself where the guidelines extend from the support pole, and thus the snow tower and the support pole must be substantially equal in height thereby limiting the height of a snow tower usable with the crane type guidance mechanism illustrated. Also, the back pressure from the nozzle discharge is quite large and exceeds the weight of the gun itself, which requires excessively large support structure. Additionally, no convenient mechanism is provided to raise and lower the nozzle tier maintenance or repair.

This prior art structure also does not provide for the possible positioning of the nozzle directly above the support pole, or for aiming the nozzle behind the support pole.

My U.S. Pat. No. 4,199,103 which issued on Apr. 22, 1980 for Adjustable Snow Making Tower discloses the elongated pipe forming the tower as pivotally connected at its bottom to the support pole, so that the tower may be pivoted in a single vertical plane such that the tower may be positioned anywhere from tilting full forward to fully rearward such that the air and water discharge nozzles are even positioned on the back side of the pole. Most any intermediate position between these full forward and full back positions may also be selected In addition, to a very limited extent, the snow making tower can be rotated left or right to a small degree to further assist in positioning the snow placement.

This invention does permit the use of a snow tower conduit which is much taller than the support pole and it does permit greater adjustability in that the nozzles may be positioned at different places in front of the pole or even behind the support pole. However, this adjustable snow making tower and the adjustable snow making tower illustrated in FIG. 6 of Loomis, do not provide any means for swinging or manipulating the entire pipe tower such that it may be additionally rotated in a horizontal plane to wide extremes, even when the pipe tower is pivoted out from the support pole at a relatively large angle such as 45° or more.

The adjustable snow making towers of the prior art, also require the use of a relatively tall support pole which must be anchored at its bottom end into the ground. Such poles are expensive and they require the use of expensive equipment and time consuming labor to raise them and anchor them into the ground.

Also, with portable snow-guns, as opposed to elongated tall snow making pipe towers, they cannot be taken full advantage of because of the fact that they cannot be easily elevated above ground for operation.

In addition, the snow making towers of the prior art cannot be readily and easily lowered to clean ice off of the tower or to replace nozzles or to remove the tower and transfer it to a new location.

It is a principal object of the present invention to provide an adjustable snow making tower wherein the elongated pipe tower or a snow-gun may not only be elevated and adjusted in a vertical plane at an angle relative to its support pole from between 0°, such that it is parallel with the support pole, all the way to the ground or horizontal for repair or maintenance of the nozzles at the top of the pole, but in addition, the entire pipe tower or snow-gun may be pivoted or rotated in a horizontal plane of 360°, no matter what vertical position the pipe tower or snow-gun is in relative to its support pole at the time. It is a further object of the present invention to eliminate the disadvantages of the adjustable snow making towers of the prior art hereinbefore described.

SUMMARY OF THE INVENTION

The adjustable snow making tower of the present invention utilizes a substantially vertical support pole, of much shorter length than the traditional support poles utilized by adjustable snow making towers of the prior art, wherein the bottom end of the support pole is anchored in the ground. This support pole may be constructed of conventional steel pipe. A pipe of slightly larger diameter is coaxially received over this support pole for support thereon and axial rotation thereon and thereabout for 360°. In addition, a support arm is pivotally connected intermediate its opposite ends to or adjacent the upper end of this rotatable pipe for pivotal movement about this pivotal connection in a vertical plane substantially from horizontal to vertical.

Snow making nozzles are detachably secured to and supported from this support arm fix elevating the nozzles at least six feet above ground level with pivotal movement of the support arm toward vertical. Air and water conduits are also provided, either by a single conduit wherein the air and water under pressure are mixed or by two separate conduits, for conveying air and water under pressure to the nozzles from a remote source. The air and water are discharged under pressure into the ambient atmosphere through the nozzles tier thereby manufacturing snow in subfreezing conditions.

The entire structure must be anchored well enough and be strong enough to withstand water pressures which are in the range of 100 psi to 1000 psi.

The nozzles and the conduit or conduits supplying the nozzle or nozzles may be in the form of a conventional portable type snow-gun which may be hung onto or otherwise secured to the support arm for elevating the snow-gun for more effective manipulation and operation. Similarly, the nozzles and conduit may be provided in the form of a elongated pipe snow making tower having an upper end and a lower end with the nozzles at the upper end and supply connections at the lower end for connection to the remote source of air and water under pressure. Additionally, the adjustable snow making tower of the present invention may be provided in a combination form wherein the support arm supports both a pipe snow making tower and a portable snow-gun simultaneously for either simultaneous or independent operation of the pipe snow tower and the snow-gun.

The pipe tower together with its supporting arm may be tilted to any preselected pivotal position and there supported by a lock mechanism to retain the snow tower and/or supported snow-gun at the selected position. Not only may the angular position of the snow tower be preselected, but in addition, the pipe tower and/or snow-gun so positioned may be easily rotated through 360° for additional directed placement of the snow to be manufactured.

Once the desired rotational position of the pipe tower and/or snow-gun has been obtained, the pivotal support pipe may be stopped from further rotation on the support pole by engagement of a stop, such as a conventional stop bolt or stop screw which is threadably received through the pipe for engagement with the underlying coaxial support pole.

While the pipe tower and/or snow-gun together with its support arm may be raised and lowered to desired angular positions by hand, it is preferable to provide a drive mechanism which is connected between the pipe and the support arm for selectively driving the support arm with its attached pipe tower and/or snow-gun mounted thereon through the desired pivotal movement.

Once the pipe tower and/or snow-gun together with its support arm has been vertically pivoted to the desired angle, the support arm is locked into position relative to the support pipe. This is preferably accomplished by simple insertion of one or more lock pins into preselected and prealigned apertures provided in space parallel ears secured to the upper end of the support pipe and positioned on opposite sides of the support arm.

The drive mechanism for raising and lowering the support arm together with its mounted pipe tower may also be readily detached for movement to another adjustable snow making tower after the aforedescribed lock mechanism has been engaged to lock the support arm in the preselected vertical angular position desired.

This drive mechanism in its simplest form may consist of nothing more than a two-way mechanical or hydraulic jack which is pivotally secured at opposite ends between the support arm and the support pipe.

The height of support of the pivoting support pipe as positioned coaxially over and on the support pole may be adjusted relative to the support pole, thereby providing a means for adjusting the overall height of the pipe tower or snow-gun relative to the ground surface. This is simply accomplished through the use of a vertical series of horizontally aligned aperture pairs through the pipe. A pin is utilized for selective reception through an aperture pair such that the pin rests on top of the support pole to support the support pipe and the entire pipe tower and/or snow-gun mechanism for axial rotation on the support pole.

When the snow making tower is provided with a pipe tower, it is preferable that this pipe tower be fixably rotatable about its axis relative to the support arm for further adjustment positioning of the nozzles at the upper end of the pipe tower. This provides much greater flexibility in being able to further orient the nozzles relative to the support arm. When the desired orientation is achieved, the pipe tower is fixed from further rotation.

A snow-gun may also be clamped to the pipe tower and rotated therewith so that the same benefits are achieved for the portable type snow-gun, which in the structure of the present invention in reality becomes a snow tower due to the fact that the otherwise portable snow-gun can be easily elevated well above ground and efficiently oriented to any desired position for effective placement of snow. As an alternative, such a snow-gun may be supported from a pole which is substituted for the pipe tower in order to exclusively support the snow-gun.

When the elongated pipe snow tower is being utilized, it is preferable that it be provided in the form of an elongated outer metal pipe for conveying water under pressure to the nozzles and an inner pipe coaxially coextending within this outer pipe for conveying air under pressure to the nozzles as taught in my aforementioned U.S. Patent. This configuration prevents freezing of moisture within the inner air line and also prevents water or moisture from freezing on the external surfaces of the pipe tower.

BRIEF DESCRIPTION OF THE DRAWINGS

Other objects and advantages appear in the following description and claims. The accompanying drawings show, for the purpose of exemplification without limiting the invention or claims thereto, certain practical embodiments illustrating the principals of this invention wherein:

DETAILED DESCRIPTION OF A PREFERRED EMBODIMENT

Referring to FIGS. 1–4, the adjustable snow making tower 10 of the present invention is comprised of substantially vertical support pole 11 (which may be a conventional steel pipe of, for example, 6½ inches in outer diameter) having its bottom end anchored into the ground surface 12. The support pole 11 is relatively short compared to support poles required for adjustable snow making towers of the prior art and may for example be approximately four to five feet above the ground surface 12.

The support pole 11 must be securely anchored into the ground because the tower 10 must support a good deal of weight, and in addition, water is being ejected from snow making tower nozzles supported by the structure of the present invention at very high pressures of 100 to 1,000 psi at angles relative to the vertical extent of the tower thereby creating very significant backward thrusts at high elevations on the tower. This obviously provides long torque arm with these forces to operate on. In addition, the tower structure of the present invention is also designed to pick up, manipulate and support otherwise portable snow-guns which further requires the structure to be well anchored and sufficiently strong.

Figures 1, 2:
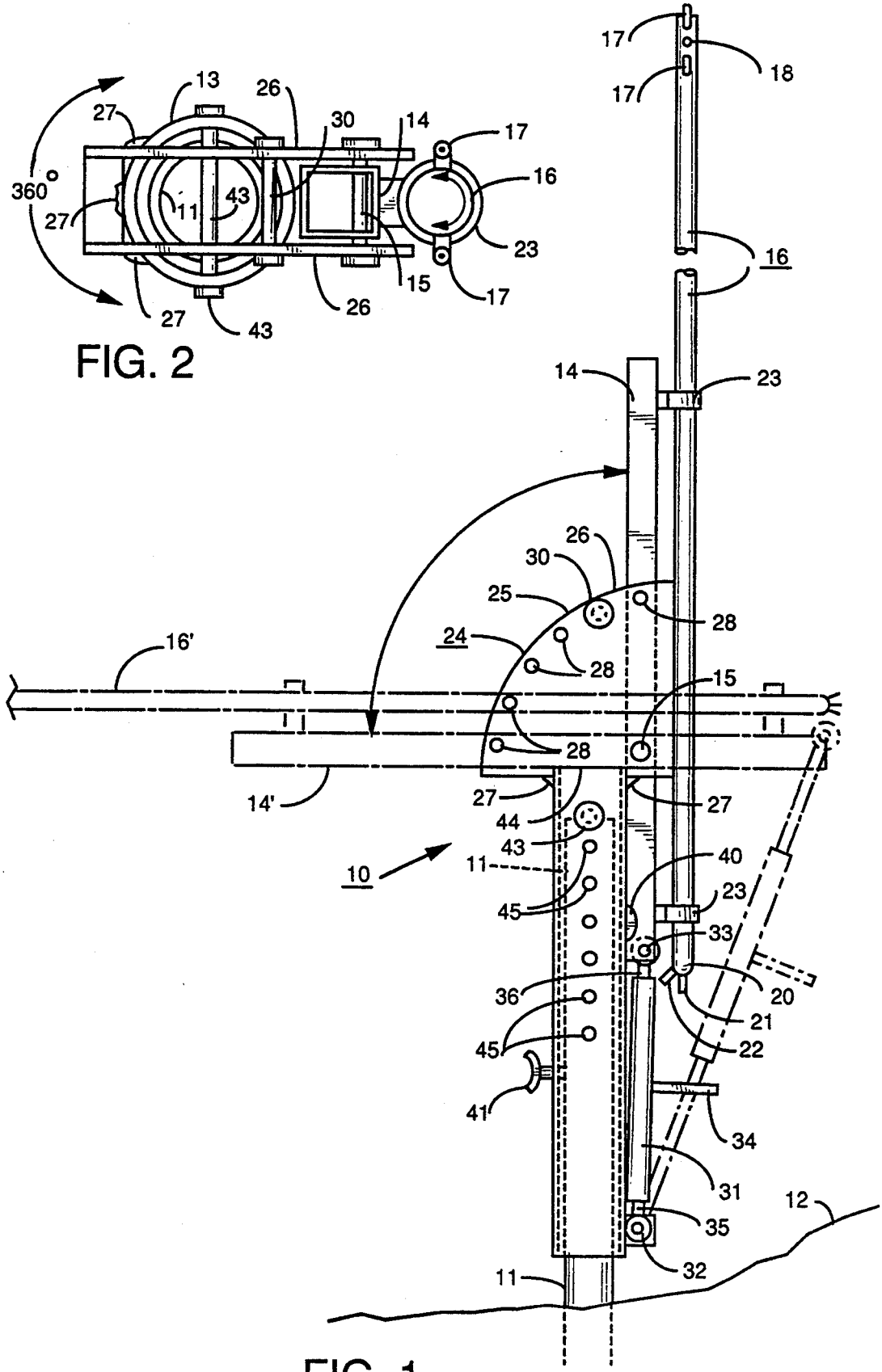
FIG. 1 is a view in side elevation of the adjustable snow making tower of the present invention.
FIG. 2 is an enlarged top or plan view of the adjustable snow making tower illustrated in FIG. 1.
Figure 3:
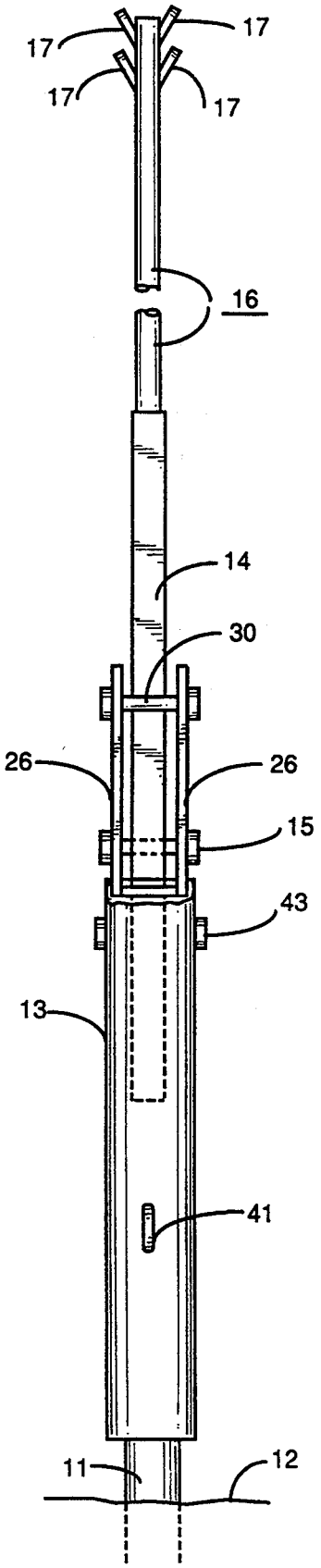
FIG. 3 is a view in left front elevation of the adjustable snow making tower illustrated in FIG. 1.
Figure 4:
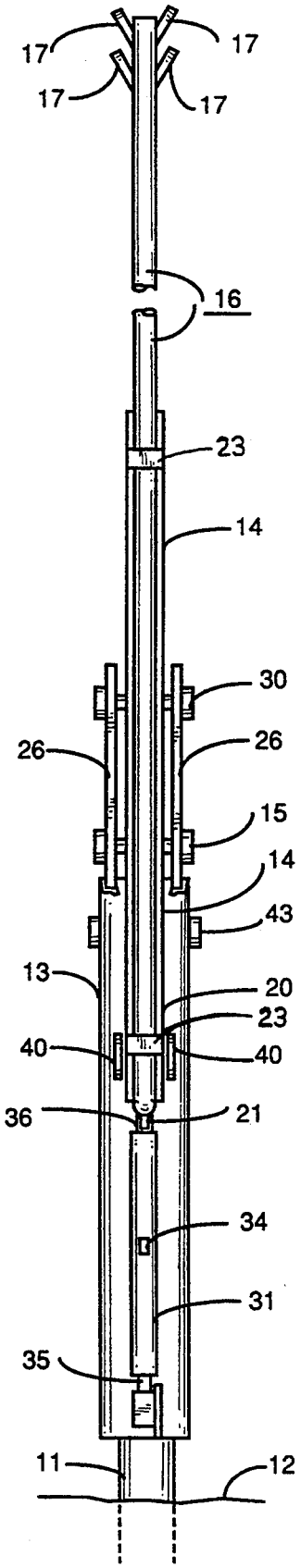
FIG. 4 is a view in right back elevation of the adjustable snow making tower illustrated in FIG. 1.

A support pipe 13 is coaxially received over support pole 11 for support thereon and free axial rotation thereon for a full 360° as particularly indicated by the arrow in FIG. 2.

A support arm 14 is pivotally connected intermediate its opposite ends at pivot pin 15, which is positioned adjacent the upper end of support pipe 13. This permits the support arm 14 to pivotally rotate substantially from horizontal, as illustrated by ghost outline 14' to vertical as indicated by the arrow shown in FIG. 1.

Elongated pipe snow making tower 16, which extends for example from forty to seventy live feet above the ground, is constructed of aluminum alloy pipe and is provided with water discharge nozzles 17 and air discharge nozzles 18 at its upper end for respective discharge of air and water into the ambient atmosphere for manufacturing snow in subfreezing conditions; However, it should be remembered that the present invention is not limited to snow making towers which externally mix the air and water discharge. The present invention is also applicable to snow towers wherein the water and air are internally mixed before discharge into the atmosphere, and as will be seen hereinafter, it is also applicable to snow-guns which are elevated and manipulated by the tower structure of the present invention.

Supply connections are also provided at the lower end 20 of the tower 16 for supplying air and water under pressure to the nozzles 18 and 17 respectively through pipe tower 16. The air supply connection is indicated at threaded pipe connection 21 and the water supply connection is indicated at the threaded pipe connection 22.

The lower end 20 of elongated pipe snow making tower 16 is secured to support arm 14 for pivotal movement therewith about the axis of pin 15 through the use of upper and lower clamps 23. Thus pipe tower 16 may also be rotated to the ground or a horizontal position with support arm 14 as indicated in ghost outline at 16'. In addition, pipe tower 16 may be fixably rotated within clamps 23 relative to support arm 14 thereby providing further maneuverability of the nozzles 17 and 18 as indicated by the right hand arrow in FIG. 2.

A lock mechanism 24 is also provided for temporarily locking the support arm 14 together with supported pipe tower 16 in preselected pivotal positions between horizontal and vertical.

The lock mechanism 24 in part includes a stop mechanism 25 which consists of a pair of spaced parallel ears 26 secured to the upper end of support pipe 13 by welds 27 and positioned on opposite sides of support arm 14. These spaced ears 26 are provided with aligned pin apertures 28 for respectively receiving a pin 30 therethrough as an engagement stop for support arm 14. In fact, when support arm 14 is in other than its vertical position as originally shown in FIG. 1, a stop pin 30 may be provided on both the front and back sides of support arm 14 to prevent further pivoting of support arm 14 about pivot pin 15 either up or down. This is desirable because the thrust of air and water being discharged under pressure from nozzles 18 and 17, can be sufficiently strong to tend to vertically raise the pole. Accordingly a stop pin 30 provided on the back side of arm 14 may be readily utilized to prevent the pipe tower 16 from raising itself due to the back pressures.

The lock mechanism 24 also preferably includes a drive mechanism 31 connected between pipe 13 at pivot connection 32 and support arm 14 at pivot connection 33 for selectively driving support arm 14 with pipe tower 16 mounted thereon through vertical pivotal movement about pivot pin 15.

This drive mechanism illustrated is a conventional two-way jack which is provided on the market as a chain binder, such as manufactured by W. W. Patterson Company or Dixie Industries, Inc. It basically consists of a ratchet operated mechanism which is manipulated by handle 34 to simultaneously extend or retract respective right hand and left hand threaded jack arms 35 and 36.

From viewing FIG. 1, it can be seen that the angle created between jack or drive mechanism 31 and support arm 14 increases as the arm 14 is raised from the horizontal position to the vertical position. This angle is an acute angle when support arm 14 is in the horizontal position and when the support arm 14 reaches a 45° angle, the angle between the drive mechanism 31 and support arm 14 becomes approximately 90° and thereafter becomes an obtuse angle as the support arm 14 together with pipe tower 16 are raised to vertical. The effect of this configuration is that as the support arm 14 is jacked upward from horizontal, the pipe tower 16 together with its support arm 14 will move faster with less strain. Jacking becomes easier as the tower 16 is being raised.

Other jack mechanisms may be substituted. For example, a conventional two-way hydraulic jack may be substituted.

After the drive mechanism 31 has been manipulated to position pipe tower 16 to the desired vertical position and one or more stop pins 30 have been inserted on opposite sides of support arm 14, the drive mechanism 31 may be readily removed and then taken to another such adjustable snow making tower for use at the new location.

When the pipe tower 16 is in its full vertical position as illustrated in the figures, support arm 14 is prevented from any lateral movement by guide ears 40 provided on opposite sides of support arm 14 and which are rigidly welded to the external surface of support pipe 13.

As previously mentioned, the pipe snow making tower 16 may also be rotated in a horizontal plane for a full 360 ° to provide proper positioning of the nozzles 18 and 17 above the ski slopes. Once this desired rotational position has been attained, the entire adjustable snow making tower is locked in position by means of stop screw or bolt 41 which is threadably received in and through the side wall of support pipe 13 such that it may be threadably fed therein until it tightly engages the outer surface of underlying support pole 11 to lock support pipe 13 from further axial rotation about support pole 11.

The support height of support pipe 13 on support pole 11 may be adjusted to different desired levels. In the figures, support pin 43 passes through support pipe 13 and internally rests on top of support pole 11 for rotation thereon. In other words, support pipe 13 together with its attached support arm 14 and pipe tower 16 may be rotated as a unit axially about support pole 11 as this entire combination is supported by support pin 43on top of pole 11.

In fact, pin 43 may be completely removed and it is permissible for the bottom edges 44 of ears 26 to frictionally ride on the top of pole 11 to support the adjustable snow making tower structure thereon for axial rotation.

Support pipe 11 is provided with a vertical series of horizontally aligned aperture pairs 45 for selectively receiving pin 43 therethrough, such that pin 43 will rest on the top of support pole 11 for axial rotation of pipe 13. This provides multiple choices of vertical levels at which the entire tower 16 may be supported above the ground 12. This is particularly advantageous for adjusting the height of the snow tower relative to the depth of snow accumulation on the ground surface 12.

Figure 5:
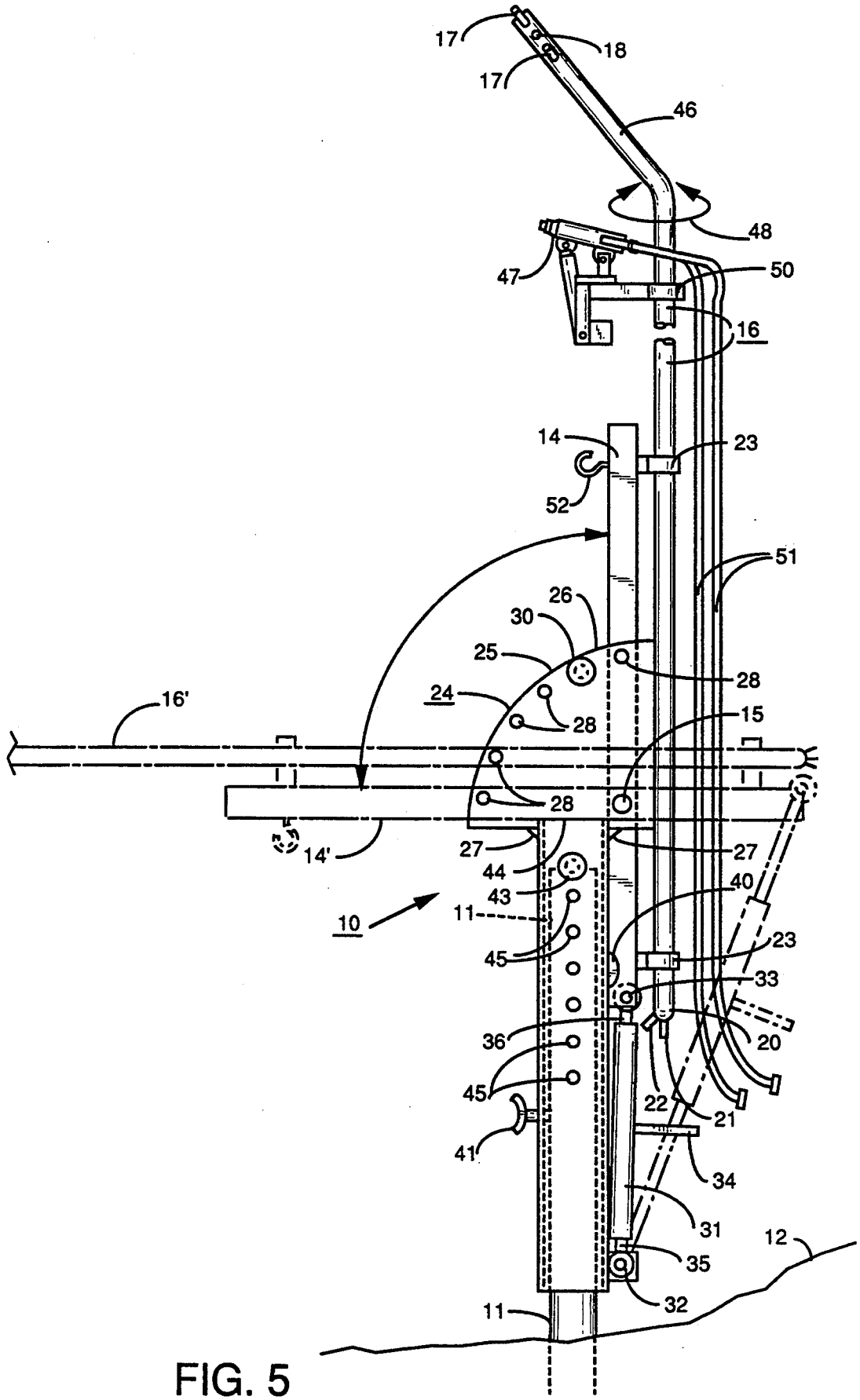
FIG. 5 is a view in side elevation showing a variation of the adjustable snow making tower of the present invention illustrating the tower as both a pipe type tower and a snow-gun tower.

Turning next to FIG. 5, another variation of the adjustable snow making tower of the present invention is illustrated and like elements are indicated with identical reference numerals. The snow tower of FIG. 5 operates in an identical manner to the structure illustrated in FIGS. 1 through 4. Basically the structure of FIG. 5 is provided with two variations; namely, a bent or angled upper end 46 on pipe tower 16 and also by means or mechanisms for additionally carrying and supporting an otherwise portable snow-gun 47.

The upper bent or angled portion 46 of pipe tower 16 permits additional desirable orientation of nozzles 17 and 18 for different wind conditions. Not only is there full maneuverability built into the adjustable tower structure 10 as previously explained, but in addition, pipe tower 16 itself may be rotated within its own mount relative to support arm 14 as indicated by arrow 48 to provide even further flexibility in orientation of nozzles 17 and 18.

For example, in extremely strong wind conditions, the pipe tower 16 may be lowered into the wind and thereby positioned such that nozzles 17 and 18 are close to the ground surface so that the snow may be directly driven to the ground from the nozzles to thereby prevent the strong winds from displacing it too far from the desired placement area. Due to the ability of the pipe tower itself to be rotated and then fixed within clamps 23, the upper bent portion 46 of the pipe tower 16 may be rotated in any desired position relative to support arm 14 and the ground surface 12 to provide the greatest possible efficiency.

Because of this overall extreme adjustability that is capable with the adjustable snow making tower 10 of present invention, more uniform distribution of snow is possible than ever before permitted by the snow making structures of the prior art.

In addition, the tower may be quickly and easily lowered to clean off ice or to replace nozzles 17 or 18 or to even remove the entire tower 16 or to attach or detach a portable snow-gun 47.

FIG. 5 further illustrates that the adjustable snow making tower 10 of the present invention may be utilized also to support, elevate and maneuver, either in substitution of or in addition to pipe snow making tower 16, conventional otherwise portable snow-gun 47. The snow-gun 47 illustrated in FIG. 5 is in particular an adjustable snow-gun which is manufactured under the trademark AUTOSNO by Ratnik Industries of Victor, N.Y. and as described and illustrated in U.S. Pat. No. 5,154,348 issued Oct. 13, 1992 for SNOW-GUN OSCILLATION CONTROL APPARATUS.

Many other snow-guns of the prior art may be attached to the adjustable snow making tower of the present invention. For example, snow-guns manufactured and sold under the trademarks YORK, DELTA, LARCHMONT, LENKO, HEDKO, SNOWMAX, OMICHORN and SILENTSTORM could also be attached to, elevated and manipulated and supported by the snow making tower structure of the present invention to thereby provide a snow making tower in accordance with the teachings of the present invention. The only limitations for so supporting a snow-gun is weight. Some of these guns include fans and may be too heavy the structure shown. Accordingly, snow-guns which weight in excess of 500 pounds will require that the snow tower structure 10 of the present invention be of heavier construction in order to support heavier guns.

In FIG. 5, the snow-gun 47 is clamped directly to an upper portion of pipe tower 16 by clamp 50. Obviously, if it is not desired to utilize the pipe tower 16 in combination with the snow-gun 47, pipe tower 16 may be substituted with any conventional support tube or pole for gun 47.

Gun 47 is fed in a conventional manner with water and air under pressure through flexible hose conduits 51.

In addition, a hook 52 is rigidly secured to the upper end of support arm 14 so that a snow-gun may be directly mounted on the hook as by chain or otherwise and thereby elevated and maneuvered by the tower structure of the present invention instead of clamping the gun directly to the pipe tower 16.

As previously noted, it is preferable that the pipe tower 16 be constructed in accordance with the teachings of my prior mentioned patent so that the outer surface of the tower 16 is warmed by the water being conveyed therethrough thereby preventing ice buildup on the pipe tower 16.

I claim:

1. An adjustable snow making tower comprising: a substantially vertical support pole having a bottom end anchored in a ground surface, a pipe having upper and lower ends and coaxially received on said pole for support and free axial rotation thereon, a support arm pivotally connected to said pipe adjacent the upper end of said pipe for pivotal movement substantially from horizontal to vertical, snow making nozzle means detachably secured to and supported from said support arm for elevating said nozzle means at least six feet above ground with pivotal movement of said support arm toward vertical, air and water supply conduit means adapted for conveying water at pressures greater than 100 psi and air under pressure to said nozzle means from a remote source for discharge into ambient atmosphere through said nozzle means for manufacturing snow in subfreezing conditions, and lock means for temporarily locking said support arm with said supported nozzle means in preselected pivotal positions.

2. The adjustable snow making tower of claim 1 wherein said nozzle means and said conduit means are comprised of an elongated pipe snow making tower having an upper end and a lower end with said nozzle means at the upper end of the tower and supply connection means at the lower end of the tower for connection to the remote source, said pipe tower secured at its lower end to said support arm for pivotal movement therewith.

3. The adjustable snow making tower of claim 2 wherein said pipe tower is fixably rotatable about its axis for further adjustment position of said nozzle means.

4. The adjustable snow making tower of claim 2 wherein an upper portion of said pipe tower is bent to an obtuse angle relative to the remainder of said pipe tower with said nozzle means disposed at the upper end of said upper portion.

5. The adjustable snow making tower of claim 1 wherein said nozzle means is a snow-gun.

6. The adjustable snow making tower of claim 1 including stop means for temporarily securing said pipe from rotation on said support pole.

7. The adjustable snow making tower of claim 6 wherein said lock means includes a drive mechanism connected between said pipe and said support arm for selectively driving said support arm with said nozzle means mounted thereon through said pivotal movement.

8. The adjustable snow making tower of claim 7 wherein said drive mechanism consists of a two-way jack pivotally secured at opposite ends between stud support arm and said pipe.

9. The adjustable snow making tower of claim 1 including adjustment means for adjusting the vertical position of said pipe relative to said support pole.

10. The adjustable snow making tower of claim 9 wherein said adjustment means consists of a vertical series of horizontally aligned aperture pairs through said pipe, and a pin for selective reception through an aperture pair such that said pin rests on the top of said support pole for said axial rotation of said pipe.

11. An adjustable snow making tower comprising: a substantially vertical support pole having a bottom end anchored in a ground surface, a support pipe having upper and lower ends and coaxially received on said pole for support and axial rotation thereon, a support arm pivotally connected to said pipe adjacent the upper end of said pipe for pivotal movement substantially from horizontal to vertical, an elongated pipe snow making tower having an upper end and a lower end with nozzle means at the upper end of the tower, air and water supply conduit means at the lower end of the tower adapted for conveying water anti air under pressure to said nozzle means from a remote source for discharge into ambient atmosphere through said nozzle means manufacturing snow in subfreezing conditions, said pipe tower secured at its lower end to said support arm for pivotal movement therewith, lock means for temporarily locking said support arm with said supported pipe tower in preselected pivotal positions, said nozzle means and said conduit means further including additional of said nozzle means secured to a selected one of said pipe snow making tower and said support arm above said pipe, and hoses connected to said additional nozzle means and to the remote source as additional of said conduit means.

12. The adjustable snow making tower of claim 11 wherein said additional nozzle means is a snow-gun.

13. An adjustable snow making tower comprising: a substantially vertical support pole having a bottom end anchored in a ground surface, a support pipe having upper and lower ends and coaxially received on said pole for support and axial rotation thereon, a support arm pivotally connected to said pipe adjacent the upper end of said pipe for pivotal movement substantially from horizontal to vertical, an elongated pipe snow making tower having an upper end and a lower end with nozzle means at the upper end of the tower, air and water supply conduit means at the lower end of the tower adapted for conveying water and air under pressure to said nozzle means from a remote source for discharge into ambient atmosphere through said nozzle means from a manufacturing snow in subfreezing conditions, said pipe tower secured at its lower end to said support arm for pivotal movement therewith, lock means for temporarily locking said support arm with said supported pipe tower in preselected pivotal positions, said lock means including a drive mechanism connected between said pipe and said support arm for selectively driving said support arm with said nozzle means mounted thereon through said pivotal movement, said lock means further including a stop mechanism for temporarily locking said support arm into position relative to said support pipe, said stop mechanism having at least one lock pin insertable in at least one pin aperture after selected pivotal adjustment of said support arm by said drive mechanism for engagement of said support arm by said drive mechanism for engagement of said support arm by said at least one pin as a stop.

14. The adjustable snow making tower of claim 13 wherein said drive mechanism includes means for readily detaching said drive mechanism for movement to another adjustable snow making tower.

15. The adjustable snow making tower of claim 13 wherein said stop mechanism consists of spaced parallel ears secured to the upper end of said pipe and positioned on opposite sides of said support arm, and said at least one pin aperture comprises a plurality of aligned pin aperture pairs providing a plurality of pin apertures in said ears for receiving said at least one lock pin therethrough as engagement stops for said support arm.

* * * * *